US006868877B2

(12) United States Patent
Lines

(10) Patent No.: US 6,868,877 B2
(45) Date of Patent: Mar. 22, 2005

(54) METHOD FOR PRODUCING A PROCESSED CONTINUOUS VENEER RIBBON AND CONSOLIDATED PROCESSED VENEER STRAND PRODUCT THEREFROM

(75) Inventor: Jerry Lee Lines, Conroe, TX (US)

(73) Assignee: Louisiana-Pacific Corporation, Portland, OR (US)

( * ) Notice: Subject to any disclaimer, the term of this patent is extended or adjusted under 35 U.S.C. 154(b) by 219 days.

(21) Appl. No.: 10/295,006

(22) Filed: Nov. 13, 2002

(65) Prior Publication Data

US 2003/0102052 A1 Jun. 5, 2003

Related U.S. Application Data

(60) Provisional application No. 60/335,419, filed on Nov. 13, 2001.

(51) Int. Cl.[7] ..... B27G 11/00; B31B 1/60; B31F 5/00

(52) U.S. Cl. ..... 144/332; 144/344; 156/60; 156/362; 156/556

(58) Field of Search ..... 144/344–346, 144/348, 209.1, 2.1, 332; 428/18, 511, 537.1, 541; 156/556–559, 563, 580, 297–299, 362, 60

(56) References Cited

U.S. PATENT DOCUMENTS

| | | | | |
|---|---|---|---|---|
| 3,674,219 | A | | 7/1972 | Harvey |
| 4,061,819 | A | | 12/1977 | Barnes |
| 4,232,067 | A | | 11/1980 | Coleman |
| 4,255,477 | A | | 3/1981 | Holman |
| RE30,636 | E | | 6/1981 | Barnes |
| 4,610,913 | A | | 9/1986 | Barnes |
| 4,672,006 | A | | 6/1987 | McGraw |
| 4,695,345 | A | | 9/1987 | Grace |
| 4,711,684 | A | | 12/1987 | Coleman |
| 4,711,689 | A | | 12/1987 | Coleman |
| 4,751,131 | A | | 6/1988 | Barnes |
| 4,797,169 | A | * | 1/1989 | Aizawa et al. ..... 156/64 |
| 5,074,945 | A | | 12/1991 | Schaefer |
| 5,096,765 | A | | 3/1992 | Barnes |
| 5,161,591 | A | | 11/1992 | Sealey |
| 5,234,747 | A | * | 8/1993 | Walser et al. ..... 428/215 |
| 5,279,691 | A | | 1/1994 | Stickland |
| 5,505,238 | A | | 4/1996 | Fujii |
| 5,524,771 | A | | 6/1996 | Kairi |
| 5,972,467 | A | | 10/1999 | Washo |
| 5,974,923 | A | * | 11/1999 | Rigby et al. ..... 83/76 |
| 6,001,452 | A | | 12/1999 | Bassett |
| 6,224,704 | B1 | | 5/2001 | Bassett |
| 6,444,079 | B1 | * | 9/2002 | Bielfeldt ..... 156/266 |
| 2002/0064622 | A1 | | 5/2002 | Courtney |

* cited by examiner

*Primary Examiner*—Allen Ostrager
*Assistant Examiner*—Shelley Self
(74) *Attorney, Agent, or Firm*—Marger Johnson & McCollom, P.C.

(57) ABSTRACT

A method for producing a processed substantially continuous veneer ribbon is provided. The method comprises providing a plurality of debarked wood logs. A substantially continuous veneer ribbon is separated from each of said plurality of debarked wood logs. The substantially continuous veneer ribbons is conveyed to a plurality of storage locations. A system is provided for processing the substantially continuous veneer ribbons introducing a plurality of the substantially continuous veneer ribbons from the storage location to the continuous veneer ribbon process system. A processed continuous veneer ribbon is formed from the plurality of the substantially continuous veneer ribbons in the continuous veneer ribbon process system.

27 Claims, 2 Drawing Sheets

METHOD FOR PRODUCING A PROCESSED CONTINUOUS VENEER RIBBON AND CONSOLIDATED PROCESSED VENEER STRAND PRODUCT THEREFROM

This app. claims priority from prov. app. Ser. No. 60,335,419 filed Nov. 13, 2001.

BACKGROUND OF THE INVENTION

Wood veneer ribbons are employed in the manufacture of plywood and laminated veneer lumber ("LVL"). In conventional methods of manufacturing these products only larger recoverable portions of the entire veneer ribbon is clipped into nominal 4'×8' sheets, dried as sheets, and used to form consolidated plywood and LVL products. In the conventional method of manufacturing parallel strand lumber ("PSL"), the dried sheets formed as described above, are clipped into narrow strips for use in manufacturing PSL. This results in high manufacturing costs due to the need for additional process equipment, additional associated operators, and a high amount of raw material waste is created.

In U.S. Pat. No. 4,061,819, Re. 30,636, U.S. Pat. No. 4,610,913, U.S. Pat. No. 4,751,131, and U.S. Pat. No. 5,096,765, long wood fibers are formed in lengths of from about 6 inches up to 4 feet. These long fibers are used in the manufacture of waferboard products and structural lumber products.

U.S. Pat. No. 4,255,477 relates to artificial lumber board comprising elongated wood strips having medial body portions of different thicknesses which are aligned longitudinally in the board and compressed.

U.S. Pat. No. 5,524,771 describes a method of enhancing multi-layer wood products by measuring the density of the veneer sheets used in the production and by grading the veneer sheets accordingly. To build up layers of the multi-layer wood, veneer sheets having a higher density are graded as surface sheets and reduced density sheets are employed as central sheets.

In U.S. Pat. No. 6,001,452 and U.S. Pat. No. 6,224,704, engineered wood products are produced from logs. Logs are said to be radially anisotropic having wood of higher density and stiffness in their outer portion adjacent the bark than is found in the inner portion thereof. The logs are machined to segregate the denser, stiffer outer wood. A first component is formed from the less dense inner wood. Second components are formed from the stiffer outer wood. Second components are then adhesively bonded to at least one edge of the first component.

U.S. Pat. No. 3,674,219 discloses creating solid pieces of timber into splinter-like strands by passing the timber through a series of rolls revolving at uniform or variable controlled speeds. A spongy mass of loosely matted fiber strands is formed. The speed of bottom rolls 2*a*, 3*a* and 4*a* is restrained so that the speed of the wood mass or log is less than the peripheral speed of the upper rolls 2, 3 and 4.

U.S. Pat. No. 4,672,006 discloses a tree processing system including removing the limbs and bark from a log. A graduated roller mill having a sequence of pairs of compressor rollers that are spaced successively closer together receives the wood. A shredder shreds the fragments of wood into a loosely bonded mat. The loose mats are chopped into wood fibers suitable for mixing into a slurry for injection molding purposes.

U.S. Pat. No. 5,074,945 discloses producing a coherent web from long slivers formed by breaking up raw wood material and then compacting same to give a web, which is subsequently glued and pressed together.

U.S. Pat. No. 5,505,238 discloses a composite wood product formed by splitting fibrous raw material. The roughly split material is then finely split and disrupted, and then dried. A single layer is formed by laterally arranging and adhering the finely split and disrupted wood pieces. The single layers are formed into a pile and subjected to heat and pressurize.

U.S. Pat. No. 5,972,467 discloses a pressure forming process for bamboo products. The bamboo is fed through a roller press having upper and lower pairs of rollers.

U.S. Pat. No. 4,232,067, U.S. Pat. No. 4,695,345, U.S. Pat. No. 4,711,684, U.S. Pat. 4,711,689, U.S. Pat. No. 5,161,591 and U.S. Pat. No. 5,279,691 are directed to a reconstituted wood product formed from webs of splintered natural wood. The splintered natural wood is broken down by crushing or like processes to produce the webs. The webs are consolidated by compression with an adhesive. A wood is passed through a pair of rollers to crush the log and form the web. In U.S. Pat. No. 4,711,684, to facilitate web formation, a roller is arranged to be reciprocated axially coupled to a piston subjected to hydraulic pressure in a cylinder. In U.S. Pat. No. 4,711,689, bonding agent and wax are applied to the web, which is then subjected to compression to consolidate the web and form the product. The compression of the web is effected once in a direction generally normal to the median plane of the web, and once in an edge to edge direction.

U.S. patent application Ser. No. 20020064622 relates to a wood board used in flooring panels. Pieced slots are introduced parallel to the grain orientation in the outer face of the flooring panel to improve surface smoothness.

SUMMARY OF THE INVENTION

Unlike conventional methods for manufacturing consolidated Parallel Strand Lumber (PSL), plywood and LVL, the present invention does not use only larger recoverable portions of the entire veneer ribbon, normally nominal 8' wide, and does not clip green veneer ribbon into nominal 4'×8' sheets, or clip dried veneer sheets or strips into narrow strands for use in producing the above-described wood products. Thus, by employing the subject invention, manufacturing costs are lowered because the need for additional process equipment and extra associated operators is circumvented, and the amount of raw material waste created is substantially reduced.

This proposed methodology, which can be used to manufacture PSL, utilizes a unique wood preparation process. In the method of the present invention, wood logs which have been debarked by known debarking techniques are employed in a method for producing a processed continuous veneer ribbon, and a consolidated processed veneer strand product therefrom.

A continuous veneer ribbon is separated from each of the plurality of debarked wood logs. The continuous veneer ribbon remains substantially intact as it is separated from the debarked wood log. Preferably, continuous veneer ribbon is peeled from the debarked wood logs. Thus, preferably, a continuous substantially intact veneer ribbon is peeled from the debarked log in a lathe.

These continuous veneer ribbons are conveyed substantially intact, without the formation of discrete sheets, to a plurality of storage locations. Preferably, the continuous veneer ribbons are transferred into a plurality of surge trays for temporary storage and subsequent metering into a continuous veneer ribbon process system. This can be accomplished on an as-available and on an as-required basis.

The plurality of storage trays will allow controlled mixing of veneer wood grades or species into the product. This is desirous for using higher cost, high strength veneers so that they are strategically placed in the product. This differs from known processes in which veneer strands are placed randomly in the product. Thus, the substantially continuous veneer ribbons can comprise a plurality of wood grades and/or a plurality of wood species continuous veneer. The continuous veneer ribbons even can comprise off-grade/species continuous veneer ribbons. Preferably, the continuous veneer ribbons are transferred from the surge trays to the continuous veneer ribbon process system.

If off-grade/species continuous veneer ribbons are provided, they can be stored in at least one separate surge tray. Strategic mixing of veneer wood grades or species can be accomplished by dedicating one or more surge trays to each grade and/or species of veneer. A surge tray could be employed to feed a given grade/species of continuous veneer ribbon into a veneer processing system without the formation of discrete sheets. A plurality of surge trays could be used for temporary storage and subsequent metering of said continuous veneer ribbons into the continuous veneer ribbon processing system without the formation of discrete sheets.

A predetermined amount of a given grade and/or species of veneer ribbon could be fed from the storage location surge trays without the formation of discrete sheets. Feeding the veneer ribbon will occur from the surge tray or trays until the desired amount of veneer ribbon is supplied. At that point, the flow of the veneer ribbon from a surge tray will be stopped. In this way, portions of the continuous veneer ribbons can be first segregated, and then introduced in predetermined amounts into the continuous veneer ribbon process system. In this way, they can be selectively located in the processed continuous veneer process system and in the product.

Utilizing continuious veneer ribbons in the process allows greater recovery of raw material as all the veneer that can be properly processed though the system will be utilized regardless of wane, holes, knots, splits, short veneer, etc. It also simplifies the process as the veneer doesn't have to be clipped into individual sheets, stacked, fed and otherwise handled as descrete sheets with it's associated processing costs, damage and waste.

The continuous veneer ribbons are transferred from said storage location surge trays to a continuous veneer ribbon process system without the formation of discrete sheets. The system provides for processing of said continuous veneer ribbons by introducing a plurality of the continuous veneer ribbons from the storage location surge trays to said continuous veneer ribbon process system without the formation of discrete sheets. In this way a processed continuous veneer ribbon can be formed from the plurality of continuous veneer ribbons in the continuous veneer ribbon process system.

As the continuous veneer ribbon is drawn from the storage location, the intact fibers are disrupted and they are extended within the continuous veneer ribbons to form an expanded processed interconnected continuous veneer ribbon having a splayed structural pattern defining a plurality of expanded openings. One such pattern would be similar to the pattern used for expanded metal. The splaying process is also employed to allow highly efficient drying of the processed interconnected continuous veneer ribbons having a splayed structural pattern.

In a preferred embodiment, the processed continuous veneer ribbon can then be dried. In this embodiment, the processed continuous veneer ribbon can be dried as a substantially continuous ribbon, much as it had been separated from the debarked log. Individual ribbons would then still be generally identifiable as such.

The dried processed interconnected continuous veneer ribbon having a splayed structural pattern would then be treated with an adhesive as hereinafter described. For instance, the dried expanded ribbon can be coated with a structural adhesive. The adhesive is typically in liquid form so that it can be applied directly to all exposed surfaces of the dried processed interconnected continuous veneer ribbon having a splayed structural pattern.

The adhesive-treated processed interconnected continuous veneer ribbon having a splayed structural pattern can then be subjected to a further, or b-stage, drying step. This can also be carried out in a dryer, such as a screen dryer, for purposes of drying the adhesive onto the adhesive-treated processed interconnected continuous veneer ribbon.

In another preferred embodiment of this invention, it is provided that the interconnected fibers of the dried processed interconnected continuous veneer ribbon having a splayed structural pattern would be further expanded. More specifically, the dried expanded processed interconnected continuous veneer ribbon would be further expanded by a splaying device after initial drying, but prior to adhesive application. In this preferred embodiment, the veneer ribbon would likely be expanded to the point of loosing it's singularity and become a more or less homogenous layer of wood strands and groups of interconnected wood strands. Next, a homogenous mat of wood strands and groups of interconnected wood strands can be formed from the further expanded layer of interconnected continuous fibers of said dried processed interconnected continuous veneer ribbon having a splayed structural pattern. This homogenous mat is capable of ultimately being formed into a consolidated processed veneer strand product.

At this point, the processed interconnected continuous veneer ribbons can be separated into a plurality of discrete processed interconnected veneer layers capable of forming a consolidated processed veneer strand mat. Preferably, a plurality of these separated discrete processed interconnected veneer strand layers can be combined to form a consolidated processed veneer strand mat in a layup system such as Raute Wood's semi-automatic merger layup system or dual tablet automatic layup system.

The consolidated processed veneer strand mat can be formed by arranging a plurality of discrete processed interconnected veneer strand layers such that a plurality of individual layers are offset from each other to form a shingling effect. These discrete processed interconnected veneer strand layers have a longitudinal axis and a lateral axis, and a plurality of said discrete processed intact veneer layers are preferably arranged to form a consolidated processed veneer strand mat so that their respective longitudinal axis and lateral axis are aligned one with the other.

In one form of the present invention, a first consolidated processed veneer strand mat, a second consolidated processed veneer strand mat, and a third consolidated processed veneer strand mat are provided. Next, the second consolidated processed veneer strand mat is joined to the first consolidated processed veneer strand mat, the first and second consolidated processed veneer strand mats being positioned so that they are angularly offset from each other in a shingling effect. Then, the third consolidated processed veneer strand mat is joined onto the second consolidated processed veneer strand mat and positioned so that they are angularly offset from each other in a shingling effect to form a multi-layered cross-banded processed veneer strand mat.

Preferably, the joining together of the consolidated mats comprises the step of joining together a plurality of multi-layered cross-banded processed veneer strand mats to form a multi-layered cross-banded consolidated processed veneer strand mat. Furthermore, the first and second consolidated processed veneer strand mats can be angularly offset so that they are positioned in perpendicular relationship with each other.

In another aspect of this invention, the second and third consolidated processed veneer strand mats can be angularly offset so that they are positioned in perpendicular relationship with each other. A pressing and curing of the consolidated processed veneer strand mat can also be conducted, preferably on said consolidated processed veneer strand mat, to form a consolidated processed veneer strand product.

A third embodiment could involve an adhesive suitable for application to green continuous veneer ribbons. In this case, the adhesive would be applied after initial splaying, preferably by incising and expansion, and just prior to drying. The advantage of this version would be that the continuous veneer ribbons and adhesive would be dried at the same time in the same dryer. This would eliminate the need for the second drying step.

The flow of prepared veneer, or the veneer mat, exits the second dryer. Then, it is clipped or sawn into a predetermined size, weight or volume in preparation for lay-up.

Veneer from the first version can be clipped or sawn to a predetermined size and laid-up. A plurality of prepared veneers can be pre-laid-up onto one another such that each individual layer of prepared veneer are end-wise offset from the other layers, in a shingling effect. Final product lay-up can consist of laying up these multi-layers of veneer, or single veneers, in such a manner as to continue the shingling effect throughout the product. Provision can also be made to turn individual veneer layers 90 degress to accommodate manufacture of a plywood type product or crossbanded PSL products.

Veneer from the second preparation version can be clipped or sawn into predetermined weight or volume, and distributed into a uniform density and size layer. In either version set forth above, the lay-up process will continue to build a continuous mat of product until a set length of product is produced. A predetermined length of the mat can then be sawn off, and the separated portion staged into a press for mat consolidation and adhesive cure. Mat consolidation and adhesive curing can be carried out by, for example, steam injection hot pressing, Microwave (MW) pre-heating or heated pressing, or conventional heating.

Once cured, the PSL billet can be cut to size and finished suitable for use by common and known sawing and finishing methods.

DETAILED DESCRIPTION OF THE PRESENT INVENTION

Figure 1:
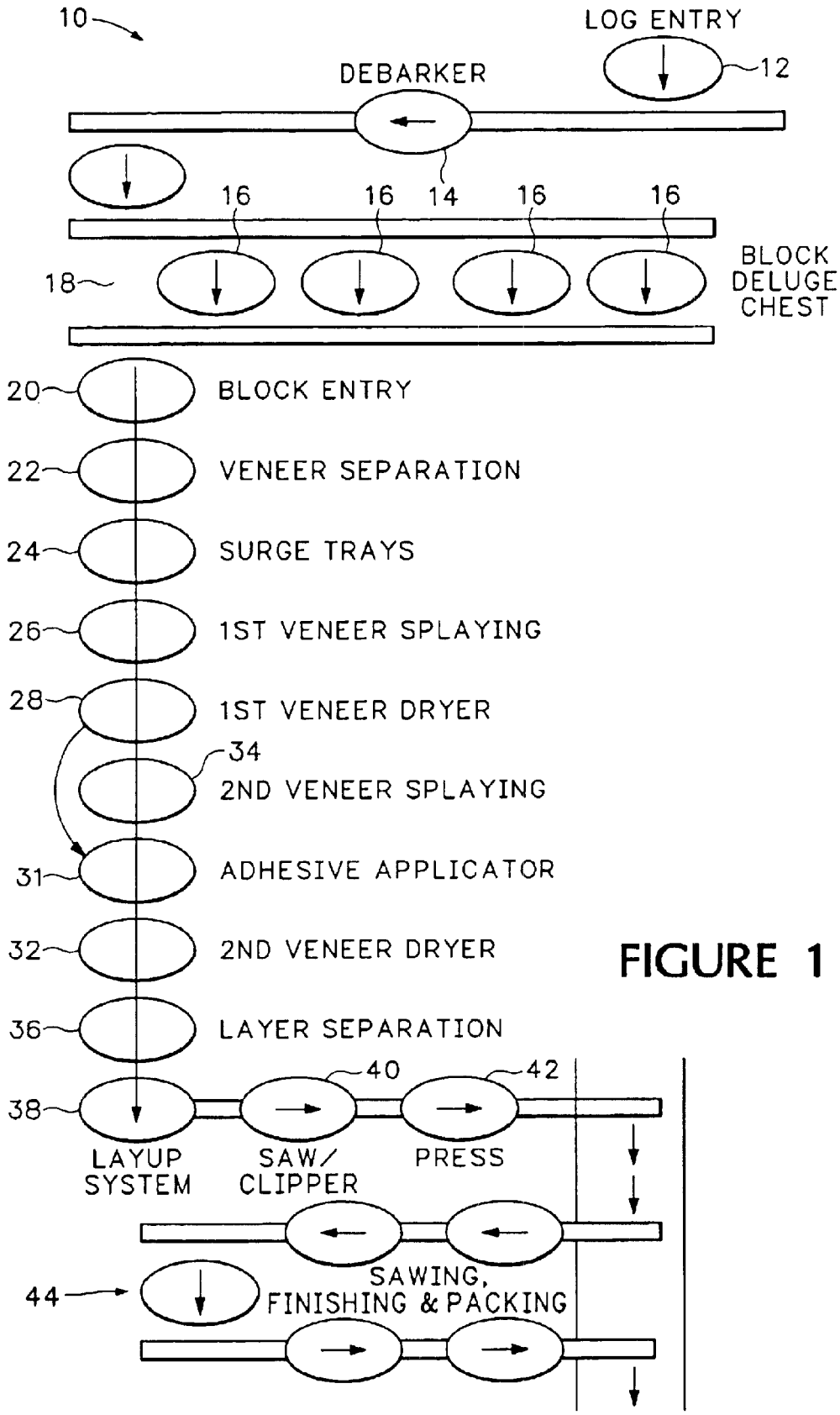
FIG. 1 is a flow diagram of a preferred method of the present invention for producing a processed continuous veneer ribbon and a consolidated processed veneer strand product therefrom.

Referring now to FIG. 1, a preferred system 10 of the present invention is depicted for producing a processed continuous veneer ribbon and a consolidated processed veneer strand product therefrom.

Conventional log collection is provided and these logs are introduced for use in the present invention via a log entry facility 12. Next, the individual logs are subjected to debarking techniques by a conventional debarker 14. The debarked logs 16 can then be stored in block deluge chests 18 until they are to be used in the present invention.

In use, logs 16 are conveyed to a block entry site 20 and then delivered to a veneer separation area 22. In this area, a continuous substantially intact veneer ribbon is separated from each of the plurality of debarked wood logs. Separation of the continuous, substantially intact veneer ribbon from the debarked log can be produced on a lathe, such as a standard rotary lathe such as a Coe Manufacturing Model 298 or Raute Wood Model VS800/2800 or, alternatively, on a Raute Wood Spindleless Lathe.

These continuous veneer ribbons are conveyed substantially intact, without the formation of discrete sheets, and are transferred into a plurality of surge trays 24, such as manufactured by Coe Manufacturing or Raute Wood, for temporary storage and subsequent metering into a continuous veneer ribbon process system. This can be accomplished on an as-available basis in which continuous veneer are employed as received in the respective surge trays. They can also be produced on an as-required basis to satisfy product requirements.

The plurality of storage trays are employed for facilitating the controlled mixing of veneer wood grades or species into the product as described above. Strategic placement of the veneer in the product can be accomplished. Substantially continuous veneer ribbons can comprise a plurality of wood grades and/or a plurality of wood species continuous veneer. The continuous veneer ribbons can comprise off-grade/species continuous veneer ribbons. These continuous veneer ribbons can be transferred from the surge trays to a primary veneer preparation system 26 without the formation of discrete sheets.

Strategic mixing of veneer wood grades or species in the primary veneer preparation system 26 can be accomplished by dedicating one or more surge trays to each off-grade/species veneer. In this way, the surge trays 24 can be employed to temporarily store and meter feed a predetermined amount of off-grade/species continuous veneer ribbon into a veneer processing system.

Feeding the veneer from the off-grade/species surge tray or trays is forthcoming until the desired amount of off-grade/species veneer is achieved. Segregation of the veneer ribbon would then be accomplished, and the flow of the off-grade/species veneer from the surge tray could then be stopped. Various portions of the continuous veneer ribbons can be segregated and then introduced in predetermined amounts into the continuous veneer ribbon process system. They can also be selectively located in the processed continuous veneer process system and in the product.

Figure 2:
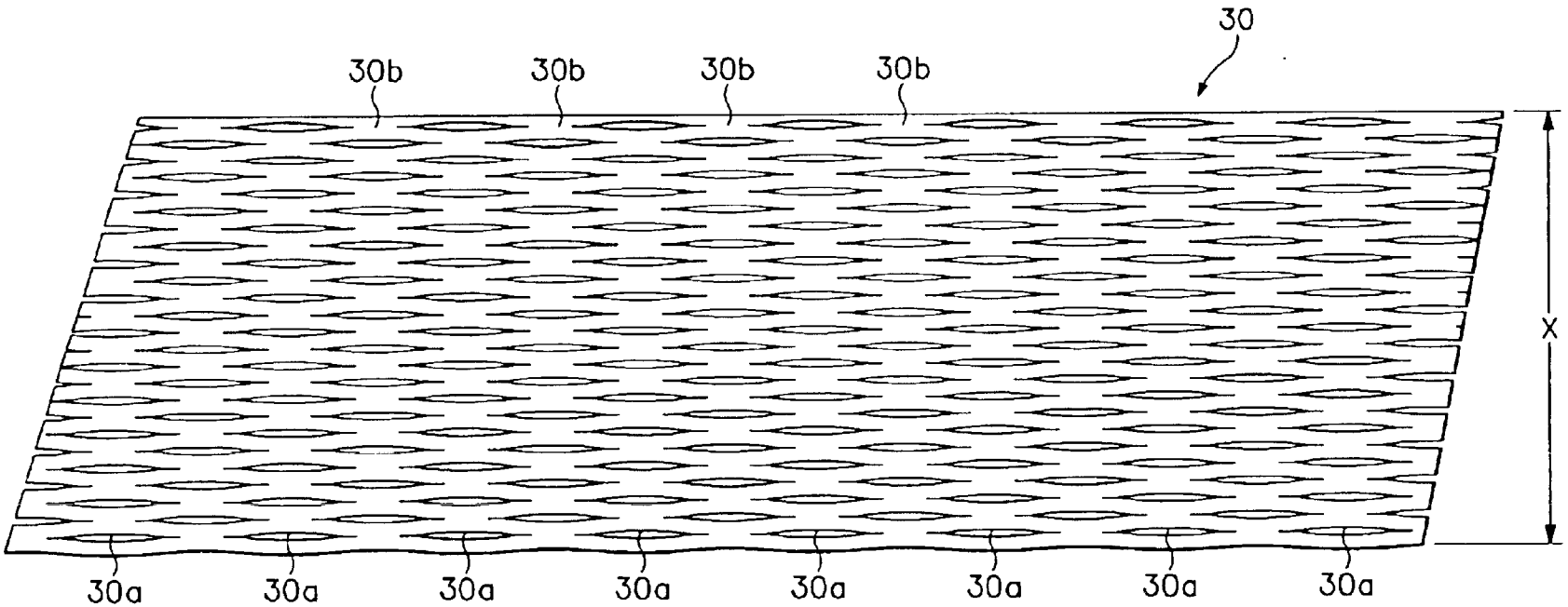
FIG. 2 is a schematic, plan view of a portion of an exemplary processed interconnected continuous veneer ribbon 30 having a preferred splayed structural pattern.

The continuous veneer ribbons are transferred from the surge trays 24 to a continuous veneer ribbon process system as previously described above without the formation of discrete sheets. The continuous veneer ribbons have a longitudinal dimension and a lateral dimension. As the continuous veneer ribbon is drawn from the storage location, the continuous veneer ribbons are subjected to veneer splaying 26 such that their intact fibers therewithin are disrupted to form an expanded processed interconnected continuous veneer ribbons 30 having a splayed structural pattern defining a plurality of expanded openings 30*a* (see FIG. 2). The continuous veneer ribbons when expanded form an extended lateral dimension "X" by the splaying of the intact fibers resulting in the formation of openings 30*a*. For example, continuous veneer ribbons can subjected to incising when they are processed through one or a plurality of top and bottom incising rolls for purposes of incising and expanding, or splaying, the continuous pass of the continuous veneer ribbons in which splaying is conducted further splays widens the extended lateral dimension of the expanded processed interconnected veneer ribbon portion 30*b* to form therein the pattern of openings 30*a*. Typically, each continuous veneer ribbons 30.

The magnitude of the extended lateral dimension X of the expanded processed interconnected continuous veneer ribbons 30 is proportional to the size of the openings 30*a* formed during splaying or pushing apart of the intact fibers. Typically, the opening 30*a* is in the form of an elongate slit. Preferably, the elongate slit narrower at it's ends and wider in it's intermediate portion. Also, the ends of the slit are preferably of a pointed configuration.

The splaying of the continuous veneer ribbons to produce expanded processed interconnected continuous veneer ribbons 30 can also relax it's structural integrity. This makes it more pliable and easy to handle in subsequent product formation steps.

In one embodiment of this invention, the processed continuous veneer ribbon can then be dried at this point in a veneer dryer 28. Typically, this drying step can be accomplished using a screen dryer such a manufactured by Raute Wood, or other type dryer, for drying the processed continuous veneer ribbon to a desired moisture content, typically to a consistency of about 8% up to about 30% by weight, based on the total weight of the dried processed continuous veneer ribbon.

Next, the dried processed continuous veneer ribbon is conveyed to an adhesive applicator 31. The adhesive bonding system of the present invention generally can comprise an isocyanate polymer and/or an aldehyde polymer resin. The adhesive bonding system can also be melamine-based or an isocyanate/latex copolymer or a phenol-formaldehyde/latex copolymer. The polymer resins can be combined together prior to their application. The subject adhesive bonding system can comprise, for example, a liquid phenolic based engineered wood adhesive designed to survive a b-stage drying process, such as Georgia Pacific Resins Inc. GP585D09.

The aldehyde polymer resins can comprise thermosetting resins such as phenol-formaldehyde, resorcinol-formaldehyde, melamine-formaldehyde, urea-formaldehyde, modified lignosulfonates, urea-furfural and condensed furfuryl alcohol resins. The phenolic component can include any one or more of the phenols which have heretofore been employed in the formation of phenolic resins and which are not substituted at either the two ortho-positions or at one ortho- and the para-position, such unsubstituted positions being necessary for the polymerization reaction. Any one, all, or none of the remaining carbon atoms of the phenol ring can be substituted. The nature of the substituent can vary widely, and it is only necessary that the substituent not interfere in the polymerization of the aldehyde with the phenol at the ortho- and/or para-positions. Substituted phenols employed in the formation of the phenolic resins include: alkyl-substituted phenols, aryl-substituted phenols, cyclo-alkyl-substituted phenols, alkenyl-substituted phenols, alkoxy-substituted phenols, aryloxy-substituted phenols, and halogen-substituted phenols, the foregoing substituents containing from 1 to 26 and preferably from 1 to 12 carbon atoms. Specific examples of suitable phenols include: phenol, 2,6 xylenol, o-cresol, m-cresol, p-cresol, 3,5-xylenol, 3-4-xylenol, 2,3,4-trimethyl phenol, 3-ethyl phenol, 3,5-diethyl phenol, p-butyl phenol, 3,5-dibutyl phenol, p-amyl phenol, p-cyclohexyl phenol, p-octyl phenol, 3,5-dicyclohexyl phenol, p-phenyl phenol, p-crotyl phenol, 3,5-dimethoxy phenol, 3,4,5-trimethoxy phenol, p-ethoxy phenol, p-butoxy phenol, 3-methyl-4-methoxy phenol, and p-phenoxy phenol.

The isocyanate polymers which can be employed in the method of the present invention can be those that are typically employed in adhesive compositions, including typical aromatic, aliphatic and cycloaliphatic isocyanate polymers. Representative aromatic isocyanate polymers include 2,4-tolylene diisocyanate, 2,6-tolylene diisocyanate, 4,4'-methylene bis(phenyl isocyanate), 1,3-phenylene diisocyanate, triphenylmethane triisocyanate, 2,4,4'-triisocyanatodiphenyl ether, 2,4-bis(4-isocyanatobenzyl) phenylisocyanate and related polyaryl polyiscocyanates, 1,5-naphthalene diisocyanate and mixtures thereof. Representative aliphatic isocyanate polymers include hexamethylene diisocyanate, xylylene diisocyanate, and 1,12-dodecane diisocyanate and lysine ethyl ester diisocyanate. Representative cycloaliphatic isocyanate polymers include 4,4'-methylenebis (cyclohexyl isocyanate), 1,4-cyclohexylene diisocyanate, 1-methyl-2,4-cyclohexylene diisocyanate and 2,4-bis(4-isocyanato cyclhexylmethyl) cyclohexyl isocyanate.

The adhesive-treated processed interconnected continuous veneer ribbon having a splayed structural pattern can then be subjected to a second veneer dryer 32 where a further, or b-stage, drying step can be conducted. This can also be carried out in a screen dryer such a manufactured by Raute Wood, or other type dryer, for purposes of drying the adhesive onto the adhesive-treated processed interconnected continuous veneer ribbon.

In a further embodiment of this invention, additional veneer splaying 34 can be provided so that the interconnected fibers of the dried processed interconnected continuous veneer ribbon are further expanded forming an extended splayed structural pattern. More specifically, the dried expanded processed interconnected continuous veneer ribbon would be further expanded by a splaying device after initial drying, but prior to adhesive application as previously stated above. In this preferred embodiment, the veneer ribbon would likely be expanded to the point of losing its singularity and become a more or less homogenous mat of wood strands and groups of interconnected wood strands.

A homogenous mat of wood strands and groups of interconnected wood strands can then be formed from the further expanded interconnected continuous fibers of said dried processed interconnected continuous veneer ribbon having a splayed structural pattern. This homogenous mat is capable of ultimately being formed into a consolidated processed veneer strand product.

At this point, the processed interconnected continuous veneer ribbons can be subjected by layer separation 36 into a plurality of discrete processed interconnected veneer layers capable of forming a consolidated processed veneer strand mat. The processed interconnected continuous veneer ribbons can be clipped or sawn into the desireable lengths and/or width. For example, some conventional processes would employ 8'×8' sized veneer layers in the formation of consolidated processed veneer strand mats.

A plurality of these separated discrete processed interconnected veneer strand layers can be combined to form a consolidated processed veneer strand mat in a layup system 38. System 38 can be Raute Wood's semi-automatic merger layup system or dual tablet automatic layup system.

The consolidated processed veneer strand mat of this invention can be formed by arranging a plurality of discrete processed interconnected veneer strand layers such that a plurality of individual layers are offset from each other to form a shingling effect. These discrete processed interconnected veneer strand layers each have a longitudinal axis and a lateral axis. A plurality of these discrete processed intact veneer layers are preferably arranged to form a consolidated processed veneer strand mat so that their respective longitudinal axis and lateral axis are aligned one with the other.

In one form of the present invention, a first consolidated processed veneer strand mat, a second consolidated processed veneer strand mat, and a third consolidated processed veneer strand mat are provided. Next, the second consolidated processed veneer strand mat is joined to the first consolidated processed veneer strand mat, the first and second consolidated processed veneer strand mats being positioned so that they are angularly offset from each other in a shingling effect. Then, the third consolidated processed veneer strand mat is joined onto the second consolidated processed veneer strand mat and positioned so that they are angularly offset from each other in a shingling effect to form a multi-layered cross-banded processed veneer strand mat. Examples of systems for producing products employing this shingling effect are set forth in U.S. Pat. No. 3,841,945, U.S. Pat. No. 3,964,552, U.S. Pat. No. 4,507,162, U.S. Pat. No. 5,948,188, and U.S. Pat. No. 5,942,079, all of which are incorporated herein by reference.

Preferably, the joining together of the consolidated mats comprises the step of joining together a plurality of multi-layered cross-banded processed veneer strand mats to form a multi-layered cross-banded consolidated processed veneer strand mat. Furthermore, the first and second consolidated processed veneer strand mats can be angularly offset so that they are positioned in perpendicular relationship with each other.

In another aspect of this invention, the second and third consolidated processed veneer strand mats can be angularly offset so that they are positioned in perpendicular relationship with each other. A pressing and curing of the consolidated processed veneer strand mat can also be conducted, preferably on said consolidated processed veneer strand mat, to form a consolidated processed veneer strand product.

A third embodiment could involve an adhesive suitable for application to green continuous veneer ribbons. In this case, the adhesive would be applied after initial splaying, preferably by inicising and expansion, and just prior to drying. The advantage of this version would be that the continuous veneer ribbons and adhesive would be dried at the same time in the same dryer. This would eliminate the need for the second drying step.

The flow of prepared veneer, or the veneer mat, exits the second dryer. Then, it is clipped or sawn into a predetermined size, weight or volume in preparation for lay-up.

Veneer from the first version can be reduced to a predetermined size by Saw/Clipper 40 and laid-up. For example, this can be done in a process similar to that used in some Laminated Veneer Lumber (LVL) layup systems such as Raute Wood's semi-automatic merger layup system. A plurality of prepared veneers can be pre-laid-up onto one another such that each individual layer of prepared veneer are end-wise offset from the other layers, in a shingling effect. Final product lay-up can consist of laying up these multi-layers of veneer, or single veneers, in such a manner as to continue the shingling effect throughout the product. Provision can also be made to turn individual veneer layers 90 degress to accommodate manufacture of a plywood type product or crossbanded PSL products.

Veneer from the second preparation version can be clipped or sawn into predetermined weight or volume, and distributed into a uniform density and size layer. The prepared mat can then be laid up in a process similar to that used for LVL such as a Raute Wood dual tablet automatic layup system. The loose layer of prepared material can be conveyed onto a first moveable belt tablet and partially onto a second moveable belt tablet. Both belt tablets would move as one to place the material over a lay-up shuttle. Once in place, both belt tables can be withdrawn from the center of the material while driving the belts at the same speed and in the opposite direction of withdrawl, thus laying the mat in a predetermined position on the lay-up shuttle. The lay-up shuttle can then be repositioned and the next lay-up is executed with an end-wise offset from the previous layer. This procedure is repeated until the desired number of layers, mat thickness, or density is reached. The shuttle then delivers the laid-up mat onto the end of the previously laid-up mat in such a manner as to continue the shingling effect, thus resulting in a continuous mat of laid-up product. If desired, the laid-up product can be stored for a period of time to facilitate substantially complete curing thereof.

In either version set forth above, the lay-up process will continue to build a continuous mat of product until a set length of product is produced. A predetermined length of the mat can then be cut using a traveling cut off saw, such as manufactured by Raute Wood, or a flying cut off saw such as manufactured by Siempelkamp Corporation, and the separated portion staged into a press 42 for mat consolidation and adhesive cure. The preferred method of mat consolidation and adhesive curing is by enclosed steam injection hot press, as manufactured by Siempelkamp Corporation, but other means, as previously described, such as conventional steam injection hot press, also as manufactured by Siempelkamp Corporation, or Microwave (MW) pre-heated or heated press such as manufactured by Dieffenbacher, Inc., or conventional heating can also be utilized.

Once cured, the cured mat can be subjected to sawing, finishing and packaging 44 in a manner suitable for use by common and known sawing, finishing and packaging methods. Equipment can be employed for these purposes such as manufactured by Raute Wood, Globe Machine Manufacturing Company, or Siempelkamp Corporation

I claim the following:

1. A method for producing a processed substantially continuous veneer ribbon, which comprises providing a plurality of debarked wood logs; separating a substantially continuous veneer ribbon from each of said plurality of debarked wood logs, said substantially continuous veneer ribbons including off-grade/species continuous veneer ribbons; conveying said substantially continuous veneer ribbons to a plurality of storage locations; providing a system far processing said substantially continuous veneer ribbons; introducing a plurality of said substantially continuous veneer ribbons from said storage location to said continuous veneer ribbon processing system; and forming a processed continuous veneer ribbon from said plurality of said substantially continuous veneer ribbons in said continuous veneer ribbon process system.

2. The method of claim 1, wherein separation of said substantially continuous veneer ribbon comprises peeling of said debarked wood logs.

3. The method of claim 1, wherein said substantially continuous veneer ribbons comprise one of a plurality of wood grades and a plurality of wood species.

4. The method of claim 1, wherein said off-grade/species substantially continuous veneer ribbons are provided in at least one separate storage surge tray location.

5. The method of claim 1, wherein said substantially continuous veneer ribbons are introduced in predetermined amounts into said continuous veneer ribbon process system so that said substantially continuous veneer ribbons are selectively located in said processed continuous veneer process system.

6. The method of claim 1, wherein said substantially continuous veneer ribbons are transferred from said storage location, to said continuous veneer ribbon process system.

7. The method of claim 1, wherein said plurality of storage locations comprise a plurality of surge trays for temporary storage and subsequent metering of said substantially continuous veneer ribbons into said continuous veneer ribbon processing system without the formation of discrete sheets.

8. A method for producing a processed substantially continuous veneer ribbon, which comprises providing a plurality of debarked wood logs; separating a substantially continuous veneer ribbon from each of said plurality of debarked wood logs, conveving said substantially continuous veneer ribbons to a plurality of storage locations; providing a system for processing said substantially continuous veneer ribbons; introducing a plurality of said substantially continuous veneer ribbons from said storage location to said continuous veneer ribbon processing system; and forming a processed continuous veneer ribbon from said plurality of said substantially continuous veneer ribbons in said continuous veneer ribbon process system which includes the step of incising and expanding intact fibers within said substantially continuious veneer ribbons to form an expanded processed interconnected continuous veneer ribbon having a splayed structural pattern.

9. The method of claim 8, wherein the splayed structural pattern comprises a splayed structural pattern of expanded openings.

10. The method of claim 8, which includes the further step of drying said processed interconnected continuous veneer ribbon having a splayed structural pattern.

11. The method of claim 10, which includes the further step of treating said dried processed interconnected continuous veneer ribbon having a splayed structural pattern with an adhesive.

12. The method of claim 11, which includes the further step of drying said adhesive-treated processed interconnected continuous veneer ribbon having a splayed structural pattern.

13. The method of claim 10, which includes the step of further expanding the interconnected fibers of said dried processed interconnected continuous veneer ribbon having a splayed structural pattern.

14. The method of claim 10, which includes the further step of forming a homogenous mat of expanded wood strands and groups of interconnected wood strands from said further expanded interconnected continuous fibers of said dried processed interconnected continuous veneer ribbon having a splayed structural pattern.

15. The method of claim 13, which includes the further step of treating said interconnected continuous veneer ribbons having a splayed structural pattern with an adhesive.

16. The method of claim 8, which includes the further step of separating said expanded processed interconnected continuous veneer ribbons into a plurality of discrete processed interconnected veneer layers capable of forming a consolidated processed veneer strand mat.

17. The method of claim 16, which includes the further step of combining a plurality of said discrete processed interconnected veneer strand layers to form a consolidated processed veneer strand mat.

18. The method of claim 17, wherein forming of a consolidated processed veneer strand mat includes the step of arranging a plurality of said discrete processed interconnected veneer strand layers such that a plurality of individual layers are offset from each other to form a shingling effect.

19. The method of claim 17, wherein said discrete processed interconnected veneer strand layers have a longitudinal axis and a lateral axis, arid a plurality of said discrete processed intact veneer layers are arranged to form a consolidated processed veneer strand mat so that their respective longitudinal axis and lateral axis are aligned one with the other.

20. The method of claim 17, which includes the steps of providing a first consolidated processed veneer strand mat, a second consolidated processed veneer strand mat, and a third consolidated processed veneer strand mat; joining said second consolidated processed veneer strand mat to the first consolidated processed veneer strand mat, said first and second consolidated processed veneer strand mats being positioned so that they are angularly offset from each other in a shingling effect; and joining said third consolidated processed veneer strand mat onto the second consolidated processed veneer strand mat and positioned so that they are angularly offset from each other in a shingling effect to form a multi-layered cross-banded processed veneer strand mat.

21. The method of claim 20, which includes the step of joining together a plurality of multi-layered cross-banded processed veneer strand mats to form a multi-layered cross-banded consolidated processed veneer strand mat.

22. The method of claim 20, wherein said first and second consolidated processed veneer strand mats are angularly offset so that they arc positioned in perpendicular relationship with each other.

23. The method of claim 20, wherein said second and third consolidated processed veneer strand mats are angularly offset so that they are positioned in perpendicular relationship with each other.

24. The method of claim 17, which includes the further step of pressing and curing said consolidated processed veneer strand mat to form a consolidated processed veneer strand product.

25. The method of claim 18, which includes the further step of pressing and curing said consolidated processed veneer strand mat to form a consolidated processed veneer strand product.

26. The method of claim 20, which includes the further step of pressing and curing said consolidated processed veneer strand mat.

27. A method for producing a processed substantially continuous veneer ribbon, which comprises providing a plurality of debarked wood logs; separating a substantially continuous veneer ribbon from each of said plurality of debarked wood logs; conveying said substantially continuous veneer ribbons to a plurality of storage locations, wherein said plurality of storage locations comprise a plurality of surge trays for temporary storage and subsequent metering of said substantially continuous veneer ribbons into a continuous veneer ribbon processing system without the formation of discrete sheets; providing a system for processing said substantially continuous veneer ribbons;

introducing a plurality of said substantially continuous veneer ribbons from said storage location to said continuous veneer ribbon processing system; and forming a processed continuous veneer ribbon from said plurality of said substantially continuous veneer ribbons in said continuous veneer ribbon process system.

* * * * *

UNITED STATES PATENT AND TRADEMARK OFFICE

CERTIFICATE OF CORRECTION

PATENT NO. : 6,868,877 B2
DATED : March 22, 2005
INVENTOR(S) : Lines

It is certified that error appears in the above-identified patent and that said Letters Patent is hereby corrected as shown below:

Column 10,
Line 58, replace “far processing” with -- for processing --.

Column 11,
Line 15, replace “location, to said” with -- location to said --.
Line 26, replace “conveving” with -- conveying --.
Line 36, replace “continuious” with -- continuous --.

Column 12,
Line 15, replace “axis, arid a” with -- axis, and a --.
Line 39, replace “they arc positioned” with -- they are positioned --.

Signed and Sealed this

Twenty-fifth Day of April, 2006

JON W. DUDAS
*Director of the United States Patent and Trademark Office*